US008992005B2

(12) United States Patent
Nogami

(10) Patent No.: US 8,992,005 B2
(45) Date of Patent: Mar. 31, 2015

(54) RECORDING APPARATUS

(71) Applicant: Canon Kabushiki Kaisha, Tokyo (JP)

(72) Inventor: Ryuji Nogami, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/012,467

(22) Filed: Aug. 28, 2013

(65) Prior Publication Data

US 2014/0063166 A1 Mar. 6, 2014

(30) Foreign Application Priority Data

Aug. 31, 2012 (JP) ..... 2012-191697

(51) Int. Cl.
*B41J 3/407* (2006.01)
*B41J 29/00* (2006.01)
*B41J 29/13* (2006.01)

(52) U.S. Cl.
CPC *B41J 29/00* (2013.01); *B41J 29/13* (2013.01); *B41J 3/4071* (2013.01)
USPC ..... 347/104

(58) Field of Classification Search
USPC ..... 347/104; 400/55, 56, 58, 59
See application file for complete search history.

(56) References Cited

U.S. PATENT DOCUMENTS 6,869,235 B2 * 3/2005 Kawaguchi et al. ..... 400/59
7,137,698 B2 * 11/2006 Miyake et al. ..... 347/104
2007/0036606 A1 * 2/2007 Takeshita et al. ..... 400/642

FOREIGN PATENT DOCUMENTS

JP 2006-036516 A 2/2006

OTHER PUBLICATIONS

Computer-generated translation of JP 2006-036516, published on Feb. 2006.*

* cited by examiner

*Primary Examiner* — Huan Tran
(74) *Attorney, Agent, or Firm* — Canon USA Inc. IP Division

(57) ABSTRACT

A recording apparatus includes a recording unit configured to record an image on a recording medium; a roller pair for conveying the recording medium or a tray with the recording medium mounted thereon, a cover covering an opening for replacing a component of the recording unit, a guide member supported by the cover and overlapping at least a part of the cover when in a closed state and capable of guiding the tray to an insertion port of the tray when in an open state, and a release member configured to, in conjunction with the opening of the guide member, to cause the roller pair to be separated, wherein if the cover is opened along with the tray, the release member does not cause the roller pair to be separated.

10 Claims, 10 Drawing Sheets

RECORDING APPARATUS

BACKGROUND OF THE INVENTION

1. Field of the Invention

The present invention relates to a recording apparatus capable of performing recording on a recording medium mounted on a tray.

2. Description of the Related Art

There has been a type of recording apparatus capable of performing recording on a recording medium of larger thickness and higher rigidity than a recording sheet, such as a compact disc. Regarding this type of recording apparatus, Japanese Patent Application Laid-Open No. 2006-036516 discusses a recording mode in which the recording medium is inserted into an apparatus main body while mounted on a tray.

FIG. 8 is a perspective view of a tray base discussed in Japanese Patent Application Laid-Open No. 2006-036516. FIG. 9 is a sectional view illustrating the tray base illustrated in FIG. 8 in the closed state. FIG. 10 is a sectional view illustrating the tray base illustrated in FIG. 8 in the open state.

As illustrated in FIG. 8, release members 105 are connected to the tray base 102. The release members 105 are supported at the front surface of the main body so as to be rotatable around a rotation shaft 106. When the tray base 102 is rotates from the state illustrated in FIG. 9 to the state illustrated in FIG. 10, the release members 105 enters a gap between a spur holder 43 and a platen 34 to raise the spur holder 43. Since inclined portions 1051 are formed at the distal end portions of the release members 105, the release member 105 can smoothly enter the gap between the spur holder 43 and the platen 34.

In a recording apparatus, an inner cover to be opened and closed at the time of replacement of a recording head and an ink tank may be provided not on the upper surface of the main body but on the front surface of the main body for a design-related reason. When, in the recording apparatus discussed in Japanese Patent Application Laid-Open No. 2006-036516, if the tray base 102 is arranged on the front side of the inner cover with respect to the main body, the tray base 102 also opens as the inner cover opens. When the tray base 102 is opened, the spur holder 43 is raised by the release members 105. When the spur holder 43 is raised, a carriage situated above the spur holder 43 and carrying the recording head and the ink tank is raised by an elevating mechanism. When the carriage is raised, the gap between the carriage and the main body upper portion is reduced. As a result, the requisite space for the operation of replacing the recording head and the ink tank is not sufficiently secured, and there is a fear of deterioration in convenience for replacing operation.

SUMMARY OF THE INVENTION

The present invention is directed to a recording apparatus capable of performing recording on a recording medium mounted on a tray, wherein it is possible to achieve an improvement in terms of convenience in recording component replacing operation even when the tray base moves in conjunction with the inner cover.

According to an aspect of the present invention, a recording apparatus includes a recording unit configured to record an image on a recording medium, a roller pair for conveying the recording medium or a tray with the recording medium mounted thereon, a cover covering an opening for replacing a component of the recording unit, a guide member supported by the cover and overlapping at least a part of the cover when in a closed state and capable of guiding the tray to an insertion port of the tray when in an open state, and a release member configured to, in conjunction with the opening of the guide member, to cause the roller pair, to be separated, wherein if the cover is opened along with the tray, the release member does not cause the roller pair to be separated.

Further features and aspects of the present invention will become apparent from the following description of exemplary embodiments with reference to the attached drawings.

DESCRIPTION OF THE EMBODIMENTS

Figure 1:
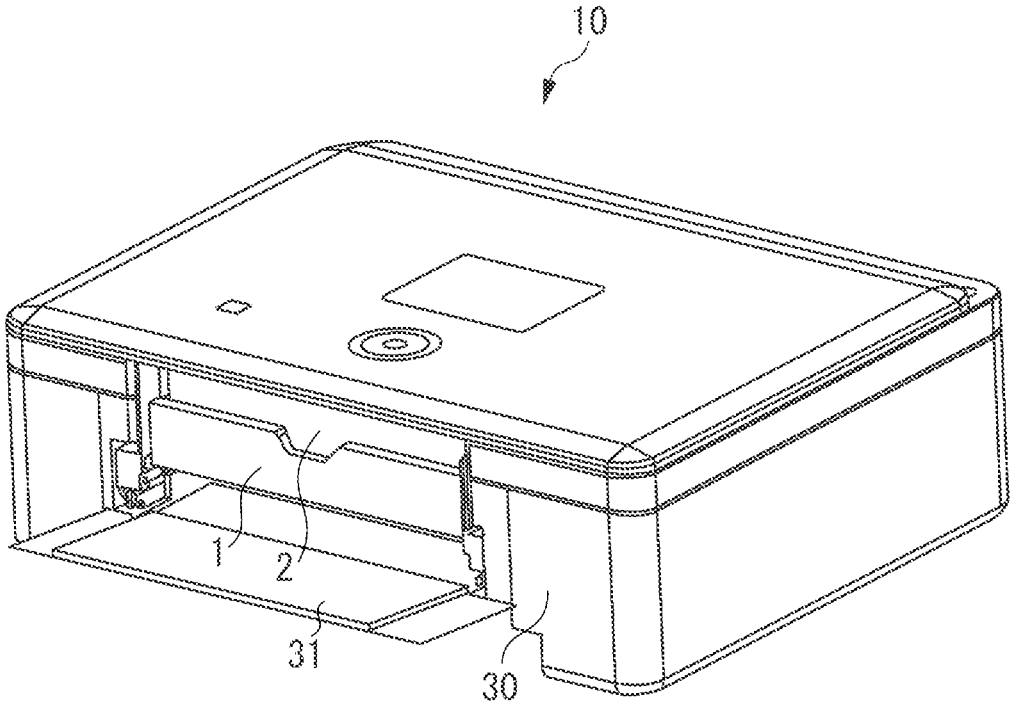
FIG. 1 is a perspective view of a recording apparatus according to an exemplary embodiment of the present invention.
Figure 2:
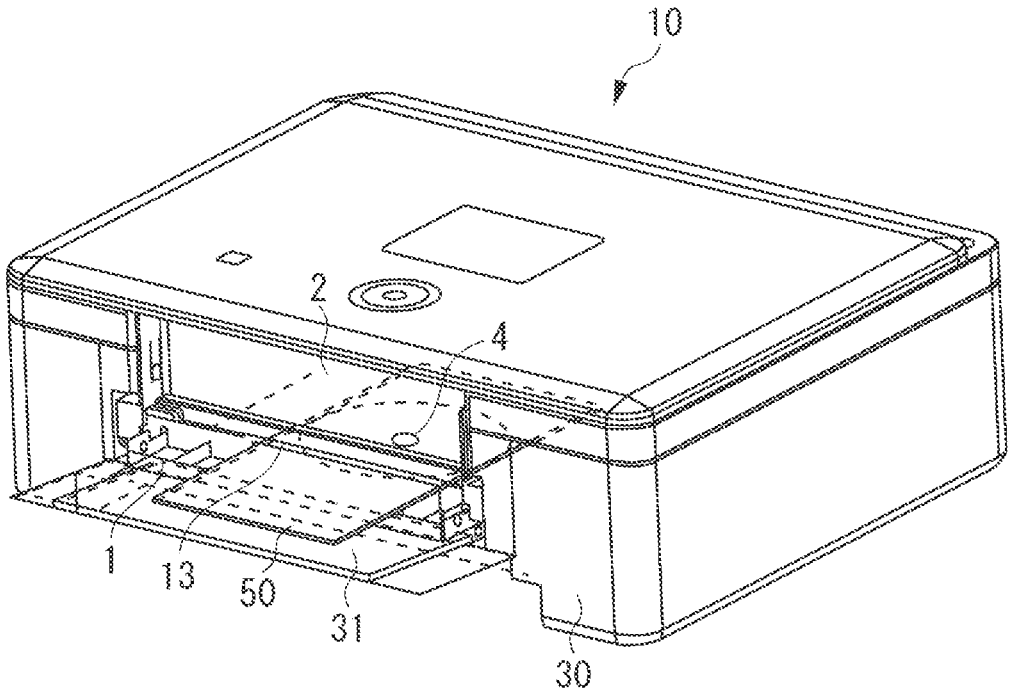
FIG. 2 is a perspective view of a recording apparatus according to an exemplary embodiment of the present invention.
Figure 3:
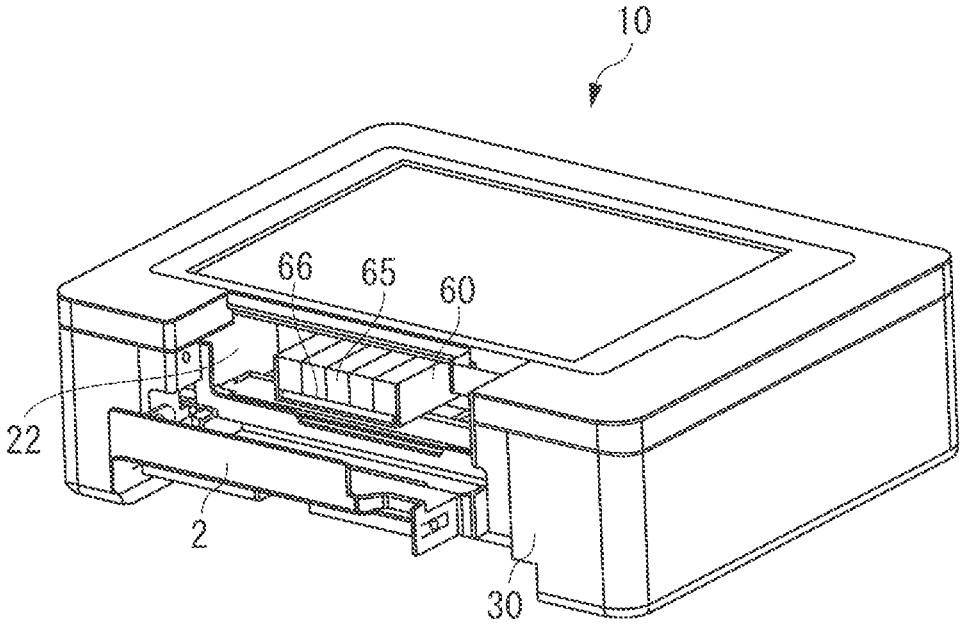
FIG. 3 is a perspective view of a recording apparatus according to an exemplary embodiment of the present invention.

FIGS. 1 through 3 are perspective views illustrating a recording apparatus according to an exemplary embodiment of the present invention. The recording apparatus according to the present invention can record an image not only on a recording sheet but also on a recording medium which is thick and of high rigidity like a compact disc. FIG. 1 illustrates a recording apparatus 10 in a state in which it performs recording on a recording medium which is thin and of low rigidity like a recording sheet. In this state, a tray base 1 rotatable with respect to the main body and an inner cover 2 configured to be opened and closed are closed. The tray base 1 is arranged on the front side of the inner cover 2 with respect to a main body 30, and overlaps at least a part of the inner cover 2.

FIG. 2 illustrates how the recording apparatus 10 performs recording on a recording medium 4 (which is a compact disc in the present exemplary embodiment) mounted on a tray 50. In this state, the tray base 1, which is a guide member for guiding the tray 50 is open, and the inner cover 2 is closed. As a result of opening the tray base 1 (i.e., rotating it to the front with respect to the main body 30), an insertion port 13 is exposed. The tray 50 with the recording medium 4 mounted thereon is inserted into the insertion port 13 while guided by the tray base 1. On the front side of the tray base 1 with respect to the insertion port 13, a front cover 31 is supported by the main body 30 so as to be capable of being opened and closed. In addition to the function of a cover covering the tray base, the front cover 31 also has the function of a discharge tray on which recording mediums can be stacked.

FIG. 3 illustrates how a component of the recording unit of the recording apparatus 10 is replaced. In this state, the inner cover 2 is open. The inner cover 2 is rotatably supported by the main body 30 such that an ink tank 65, which is a replaceable recording component, and a recording head 66 are exposed from the side of an insertion port 22 which is an opening formed in the main body 30. The ink tank 65 and the recording head 66 are accommodated in the main body while mounted on a carriage 60.

Figure 4:
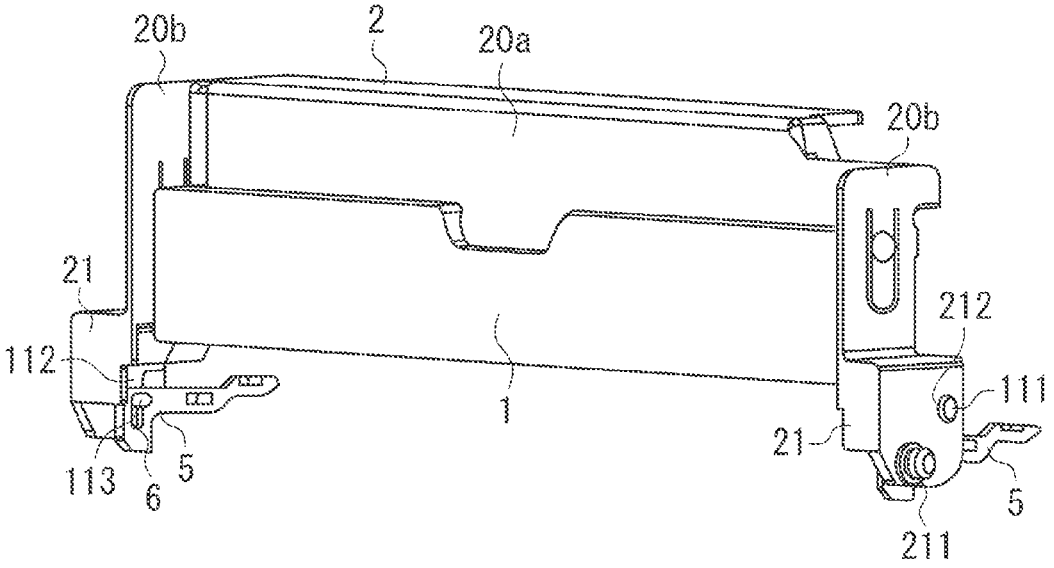
FIG. 4 is a perspective view of a tray base and an inner case.

FIG. 4 is a perspective view of the tray base 1 and the inner case 2.

On both sides in the longitudinal direction of the tray base 1, end surface members 112 each having a rotation shaft 111 and a boss portion 113 are provided. Further, the end surface members 112 extend downwards from a tray guide portion which is a portion for guiding the tray of the tray base 1. The rotation shafts 111 protrude from the outer surfaces of the end surface members 112. The boss portions 113 protrude from the inner surfaces of the end surface members 112. In the end surface members 112, the boss portions 113 are arranged below the rotation shafts 111. The tray base 1 is supported by the inner cover 2 so as to be rotatable around the rotation shafts 111. A hole portion 6 formed at one end of each release member 5 is fit-engaged with the boss portion 113. As a result, the release members 5 are connected to the boss portions 113. That is, the release members 5 are rotatably connected to the boss portions 113 serving as connecting portions.

The inner cover 2 has a bottom surface 20*a* facing the tray base 1, and a pair of side surfaces 20*b* respectively protruding from both sides in the longitudinal direction of the bottom surface 20*a*. An end surface member is provided under each side surface 20*b*. Each end surface member 21 has a rotation shaft 211 and a hole portion 212 situated above the rotation shaft 211. The rotation shaft 111 is rotatably fit-engaged with the hole portion 212. The inner cover 2 is supported by the main body 30 so as to be rotatable around the rotation shafts 211. Thus, the rotation center of the inner cover 2 is situated below the rotation center of the tray base 1. The release members 5 are connected to the connecting portions between the rotation center of the inner cover 2 and the rotation center of the tray base 1.

In the following, the operation of the tray base 1 and the operation of the inner cover 2 will be described.

Figure 5:
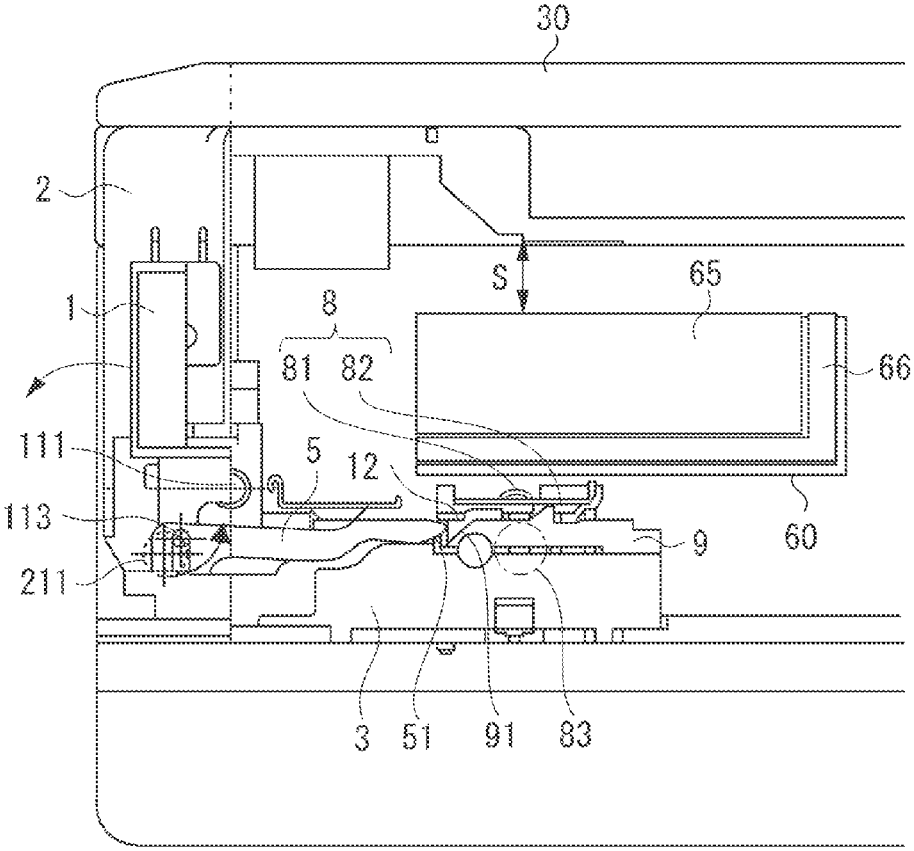
FIG. 5 is a sectional view illustrating the interior of a main body when the tray base and the inner cover are closed.

FIG. 5 is a sectional view illustrating the interior of the main body when tray base 1 and the inner cover 2 are closed. FIG. 5 illustrates the interior of the main body of the recording apparatus 10 illustrated in FIG. 1.

Inside the main body 30, there is provided a platen 9, which is a sheet guide serving as a sheet guide guiding and supporting a recording medium. A conveyance mechanism 8 for the recording medium faces the platen 9 from above. The conveyance mechanism 8 is formed by a spur 81, and a spur holder 82 which is a support member retaining the spur 81. The spur holder 82 is downwardly urged by a spring (not illustrated) with a predetermined elastic force. The spur 81 is held in press contact by the elastic force with a discharge roller 83 arranged below. The spur 81 and the discharge roller constitute a roller pair. The spur holder 82 supports one roller of the roller pair. The carriage 60 is arranged above the conveyance mechanism 8.

In FIG. 5, the distal end portions of the release members 5 are situated on the front side of a gap 12 formed between the platen 9 and the spur holder 82. The distal end portions have inclined portions 51 inclined so as to be tapered off to a point. Also the platen 9 has a second inclined portion 91 held in slide contact with the inclined portions 51 of the release members 5.

Figure 6:
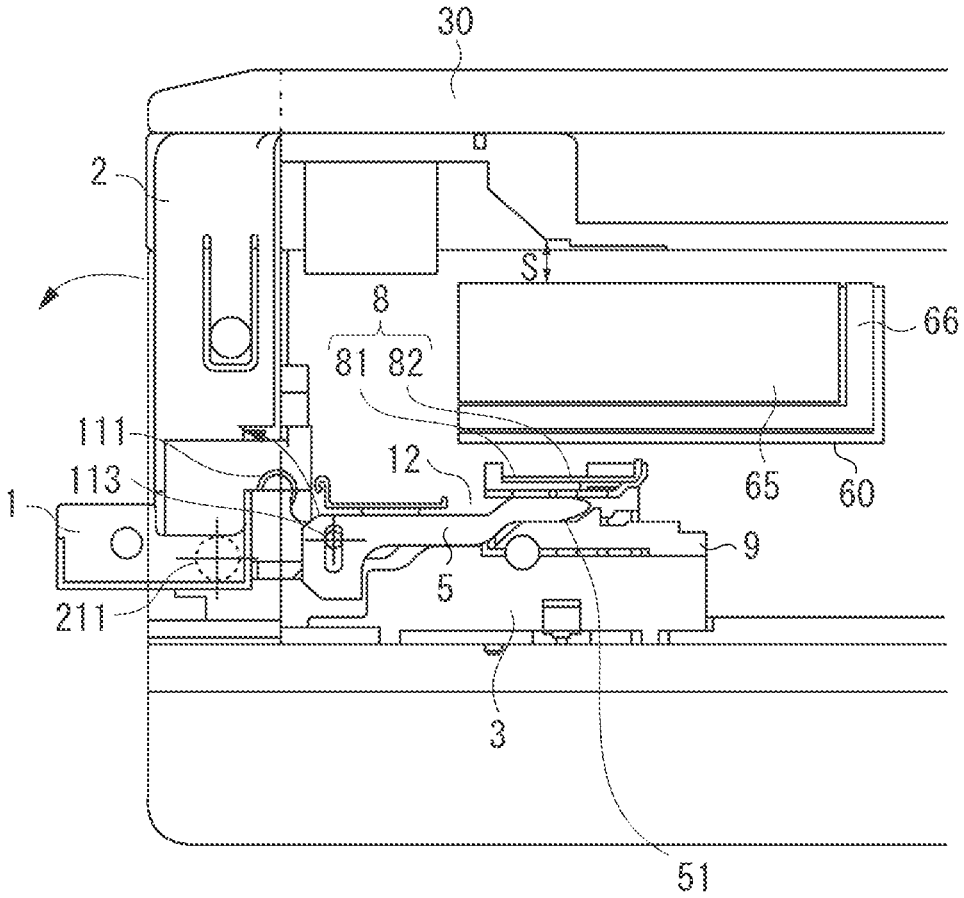
FIG. 6 is a sectional view illustrating the interior of the main body when the tray base is open and the inner cover is closed.

FIG. 6 is a sectional view illustrating the interior of the main body when the tray base 1 is open and the inner cover 2 is closed. FIG. 6 illustrates the interior of the main body of the recording apparatus 10 illustrated in FIG. 2.

When the tray base 1 rotates from the closed position illustrated in FIG. 5 to the open position illustrated in FIG. 6, the boss portions 113 arranged below the rotation shafts 111 move with a circular arc locus to approach the main body side. The release members 5 connected to the boss portions 113 enters the above-described gap 12 to abut on the spur holder 82, raising the spur holder 82 to the carriage 60 side (the recording component side). At this time, owing to the inclined portions 51 formed at the distal end portions of the release members 5, the release members 5 can smoothly enter the gap 12. As a result of the ascent of the spur holder 82, a space allowing passage of the tray 50 is formed between the platen 9 and the spur 81. At the same time, the spur 81 constituting one roller of the roller pair is separated from the discharge roller 83 constituting the other roller.

When the spur holder 82 ascends, and the tray 50 with the recording medium mounted thereon is inserted up to the platen 9 from the insertion port 13, an elevating mechanism (not illustrated) raises the carriage 60. With the ascent of the carriage 60, the gap S between the main body upper portion and the carriage becomes narrower. The elevating mechanism is formed, for example, by a shaft supporting the carriage 60 so as to allow it to move in the scanning direction, a cam member capable of elevating the shaft based on the detection of the tray 50 by a sensor (not illustrated) previously provided on the carriage 60, etc.

When the tray base 1 rotates from the open position illustrated in FIG. 6 to the closed position illustrated in FIG. 5, the release members 5 are separated from the spur holder 82. The spur holder 82 is lowered to the initial position illustrated in FIG. 5 by the above-described elastic force of the spring.

Figure 7:
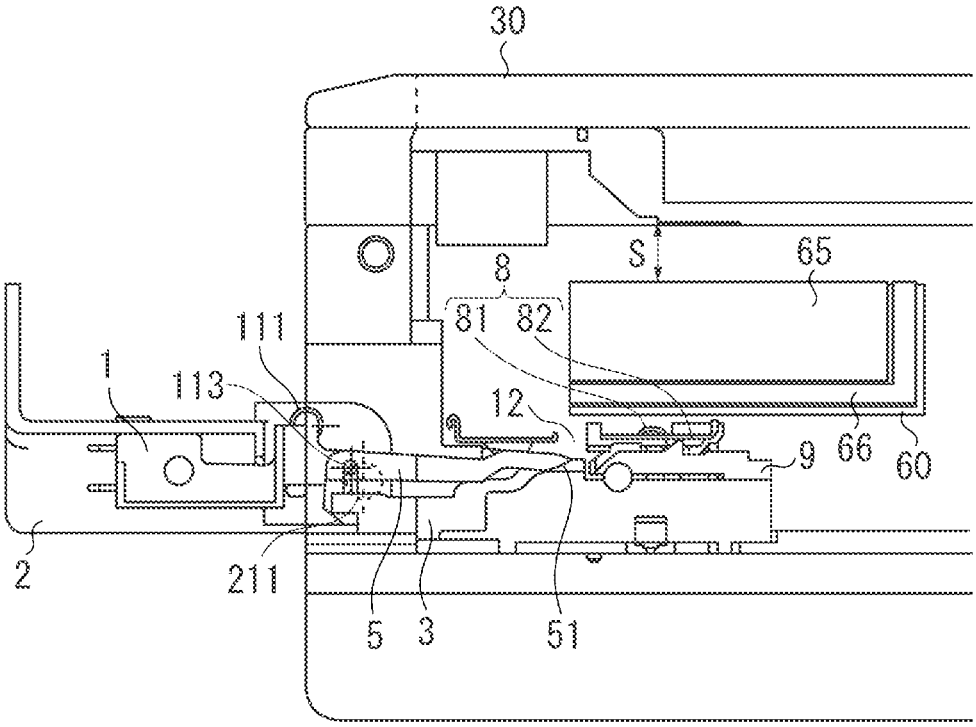
FIG. 7 is a sectional view illustrating the interior of the main body when the inner cover is open.
Figure 8:
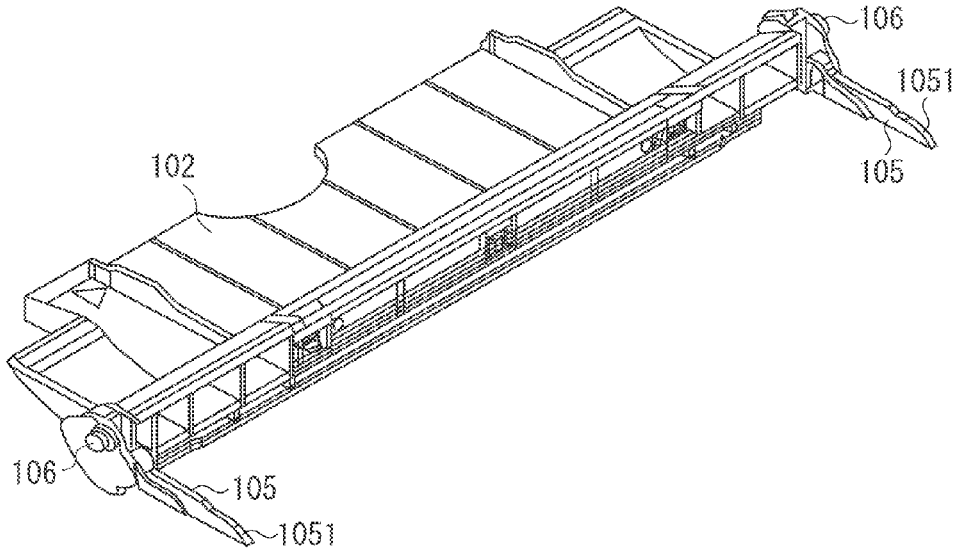
FIG. 8 PRIOR ART
FIG. 8 is a perspective view of a tray base discussed in Japanese Patent Application Laid-Open No. 2006-036516.
Figure 9:
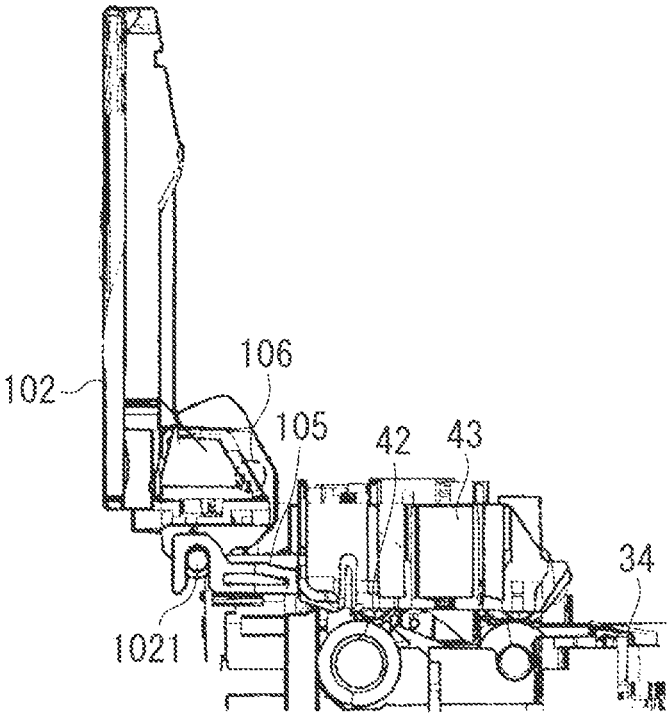
FIG. 9 PRIOR ART
FIG. 9 is a sectional view illustrating the tray base illustrated in FIG. 8 in the closed state.
Figure 10:
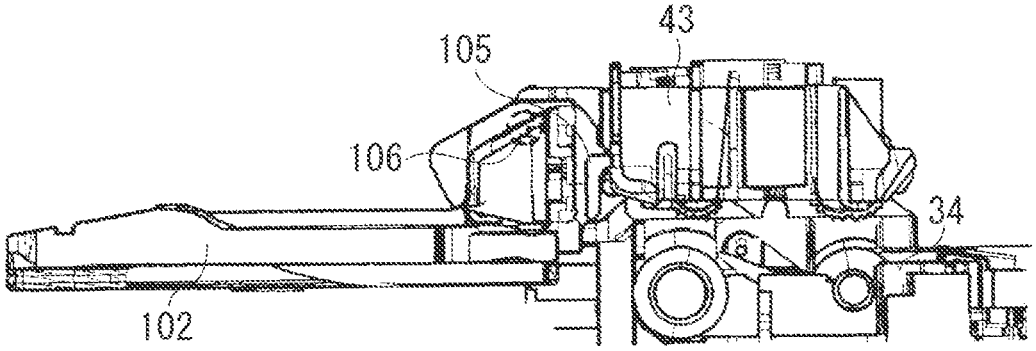
FIG. 10 PRIOR ART
FIG. 10 is a sectional view illustrating the tray base illustrated in FIG. 8 in the open state.

FIG. 7 is a sectional view illustrating the interior of the main body when the inner cover 2 is open. FIG. 6 illustrates the interior of the main body of the recording apparatus 10 illustrated in FIG. 3.

When, in the state in which the tray base 1 is in the open state illustrated in FIG. 6, the inner cover 2 rotate in the same direction as the tray base 1, the rotational force is transmitted to the rotation shafts 111 of the tray base 1 inserted into the end surface members 21 of the inner cover 2. The rotation shafts 211 of the inner cover 2 are arranged below the rotation shafts 111 of the tray base 1 as illustrated in FIG. 4, so that the tray base is moved away from the main body 30 by the rotational force transmitted from the inner cover 2. As a result of the movement of the tray base 1, the release members 5 are separated from the spur holder 82 (i.e., drawn out of the gap 12). The spur holder 82 is lowered to the initial position illustrated in FIG. 5 by the elastic force of the spring described above. As illustrated in FIG. 7, at the time of completion of the rotation of the inner cover 2, the tray base 1 is accommodated in the inner cover 2. More specifically, the tray base 1 is accommodated in the recess formed by the above-described bottom surface 20*a* and a pair of side surfaces 20*b* (see FIG. 4).

As illustrated in FIG. 7, when the inner cover 2 rotates, the above-described elevating mechanism (not illustrated) lowers the carriage 60. The elevating mechanism lowers the carriage 60 based, for example, on the detection result of a sensor (not illustrated) for detecting the rotation of the inner cover 2. As a result of the descent of the carriage 60, the gap S between the main body upper portion and the carriage is enlarged. Thus, the requisite space for the operation of replacing the ink tank 65 or the recording head 66 is sufficiently secured. As a result, an improvement is achieved in terms of convenience in replacing operation.

Also when the tray base 1 and the inner cover 2 are opened at the same time, the release members 5 are separated from the spur holder 82 with the movement of the tray member 1. Thus, the spur holder 82 does not ascend, so that the gap S between the main body upper portion and the carriage 60 is not reduced as illustrated in FIG. 6. That is, the roller pair is not separated.

In the recording apparatus 10 according to the present exemplary embodiment, the rotation shafts 211 of the inner cover 2 are arranged below the rotation shafts 111 of the tray base 1, and the release members 5 are connected to the tray base 1 between the rotation shafts 211 and the rotation shafts 111. Thus, when the inner cover 2 is rotated, the tray base 1 moves away from the main body 30. In conjunction with this movement, the release members 5 are separated from the spur holder 82. As a result, the spur holder 82 is not raised by the release members 5, so that there is no need to raise the carriage 60 (the ink tank 65 and the recording head 66). Thus, the requisite space for the operation of replacing the ink tank 65 or the recording head 66 is secured to a sufficient degree, so that it is possible to achieve an improvement in terms of convenience in replacing operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-191697 filed Aug. 31, 2012, which is hereby incorporated by reference herein in its entirety.

What is claimed is:

1. A recording apparatus comprising:

a recording unit configured to record an image on a recording medium;

a roller unit for conveying a tray with a recording medium mounted thereon;

a cover covering an opening for replacing a component of the recording unit;

a guide member supported to be overlapped on the cover when in a closed state and capable of guiding the tray to an insertion port of the tray when in an open state; and a release member configured, in conjunction with the opening of the guide member, to cause the roller unit to be separated, wherein when the cover is opened along with the guide member, the release member does not cause the roller unit to be separated.

2. The recording apparatus according to claim 1, further comprising a platen for supporting the tray when recording, wherein, in conjunction with the opening of the guide member, the release member causes the roller unit to be separated from the platen by lifting the roller unit.

3. The recording apparatus according to claim 2, wherein the roller unit includes a roller and a support member supporting the roller, and wherein the release member causes the support member to lift by entering between the support member and the platen while pushing away the support member.

4. The recording apparatus according to claim 3, wherein the release member includes an inclined portion for its entering between the support member and the platen.

5. The recording apparatus according to claim 4, wherein the platen includes an inclined part configured to be brought into slide contact with the inclined portion of the release member when the release member enters between the support member and the platen.

6. The recording apparatus according to claim 2, wherein the guide member includes a tray guide portion configured to guide the tray and a connecting portion to which the release member is connected, and wherein a rotation center of the guide member is arranged between the tray guide portion and the connecting portion.

7. The recording apparatus according to claim 6, wherein a rotation center of the cover is situated below the rotation center of the guide member, and wherein the release member is connected to the connecting portion between the rotation center of the cover and the rotation center of the guide member.

8. The recording apparatus according to claim 1, further comprising a front cover provided in front of the guide member, that can be opened to become a discharge tray of a recording medium.

9. The recording apparatus according to claim 2, wherein the recording unit has a carriage mounting the component, and the carriage is lifted from the platen when the roller unit is lifted.

10. The recording apparatus according to claim 9, wherein the component is one of an ink tank and a recording head.

* * * * *